US010840639B1

(12) United States Patent
Chvala

(10) Patent No.: US 10,840,639 B1
(45) Date of Patent: Nov. 17, 2020

(54) QUICK CONNECT ELECTRICAL CONNECTOR SYSTEM

(71) Applicant: Carlisle Interconnect Technologies, Inc., St. Augustine, FL (US)

(72) Inventor: Joseph W. Chvala, St. Augustine, FL (US)

(73) Assignee: Carlisle Interconnect Technologies, Inc., St. Augustine, FL (US)

( * ) Notice: Subject to any disclaimer, the term of this patent is extended or adjusted under 35 U.S.C. 154(b) by 0 days.

(21) Appl. No.: 16/568,683

(22) Filed: Sep. 12, 2019

(51) Int. Cl.

| | |
|---|---|
| ***H01R 13/629*** | (2006.01) |
| ***H01R 13/639*** | (2006.01) |
| ***H01R 13/6463*** | (2011.01) |
| ***H01R 13/659*** | (2011.01) |
| ***H01R 13/52*** | (2006.01) |
| ***H01R 13/627*** | (2006.01) |

(52) U.S. Cl.
CPC ..... *H01R 13/629* (2013.01); *H01R 13/5213* (2013.01); *H01R 13/639* (2013.01); *H01R 13/6463* (2013.01); *H01R 13/659* (2013.01); *H01R 13/6275* (2013.01)

(58) Field of Classification Search
CPC H01R 13/6275; H01R 13/627; H01R 13/639; H01R 13/659; H01R 13/6582; H01R 13/422; H01R 13/4226; H01R 13/426; H01R 13/05; H01R 13/18
See application file for complete search history.

(56) References Cited

U.S. PATENT DOCUMENTS

| | | | | |
|---|---|---|---|---|
| 4,941,846 A * | 7/1990 | Guimond | H01R 24/542 | 439/180 |
| 4,958,857 A * | 9/1990 | Sixsmith | F16L 47/06 | 285/21.2 |
| 5,919,066 A * | 7/1999 | Harting | H01R 13/111 | 439/825 |
| 6,093,043 A * | 7/2000 | Gray | H01R 13/6277 | 439/352 |
| 6,290,525 B1 * | 9/2001 | Jacobi | H01R 13/6277 | 439/310 |
| 7,033,195 B2 * | 4/2006 | Murphy | H01R 9/05 | 439/307 |
| 7,726,999 B2 * | 6/2010 | Vanzo | H01R 13/6397 | 439/318 |
| 7,887,365 B1 * | 2/2011 | Orner | H01R 9/0518 | 439/585 |

(Continued)

*Primary Examiner* — Briggitte R. Hammond
(74) *Attorney, Agent, or Firm* — Wood Herron & Evans LLP

(57) ABSTRACT

An electrical connector system includes a connector with a plug. A shroud extends over a portion of the plug and is coupled with the plug. A conductive socket is configured for receiving the plug of the connector. The socket includes a groove formed on an outer surface thereof. The shroud includes spring fingers having a lock portion thereon configured for engaging the groove for securing the connector in the socket. A collar is slidably mounted on the conductive socket and is configured for sliding between a locked position proximate to the socket groove and an unlocked position. The collar is further configured for engaging the spring fingers of the connector shroud in the locked position to hold the finger lock portions engaged with the groove to lock the connector in the socket.

19 Claims, 12 Drawing Sheets

(56) References Cited

U.S. PATENT DOCUMENTS

| | | | | |
|---|---|---|---|---|
| 8,491,199 | B1 * | 7/2013 | Dang | G02B 6/3821 385/84 |
| 9,692,174 | B1 * | 6/2017 | Yu | H01R 13/622 |
| 9,917,399 | B2 * | 3/2018 | Gessford | H01R 13/6271 |
| 10,096,937 | B2 * | 10/2018 | Shao | H01R 9/0521 |
| 10,348,037 | B2 * | 7/2019 | Ilie | H01R 13/18 |
| 10,355,406 | B2 * | 7/2019 | Joniak | H01R 13/436 |

* cited by examiner

QUICK CONNECT ELECTRICAL CONNECTOR SYSTEM

FIELD OF THE INVENTION

This invention is directed generally to an electrical system and specifically to a system for handling the delivery of power signals and power, such as in an aircraft environment.

BACKGROUND OF THE INVENTION

For the provision of electrical signals, and particularly power signals, in a structure such as an aircraft, a number of various solutions have been offered. For example, terminal blocks are often used. Such terminal blocks provide a plurality of terminals and connectors often have to be bolted down to the terminal blocks. Further, such terminal blocks present exposed "hot" or "live" contact surfaces that may be subject to arcing or other issues. Still further, such arrangements require time consuming installation steps in the connection and disconnection of the power terminals. In other arrangements, connectors might be used that utilize connector elements that screw together. But such configurations are not often utilized in a terminal block arrangement and are difficult to reconfigure for a multiple contact assembly.

Such power delivery systems in an aircraft environment are also subject to harsh environments and must be robust in their construction to be able to handle motion and vibration stresses that can jeopardize the electrical connection. Such systems must also address the issue of possible arcing because of the proximity to other connectors or other terminals. Still further such terminal blocks or equipment connections have to handle exposure to the elements and corrosive liquids.

Therefore, many needs still exist in this area of technology regarding providing an efficient and robust electrical connection, such as for providing a robust power signal delivery in an aircraft environment.

BRIEF DESCRIPTION OF THE DRAWINGS

The accompanying drawings, which are incorporated in and constitute a part of this specification, illustrate embodiments of the invention, and together with a general description of the invention given above and the detailed description given below serve to explain the invention.

DETAILED DESCRIPTION

Figure 1:
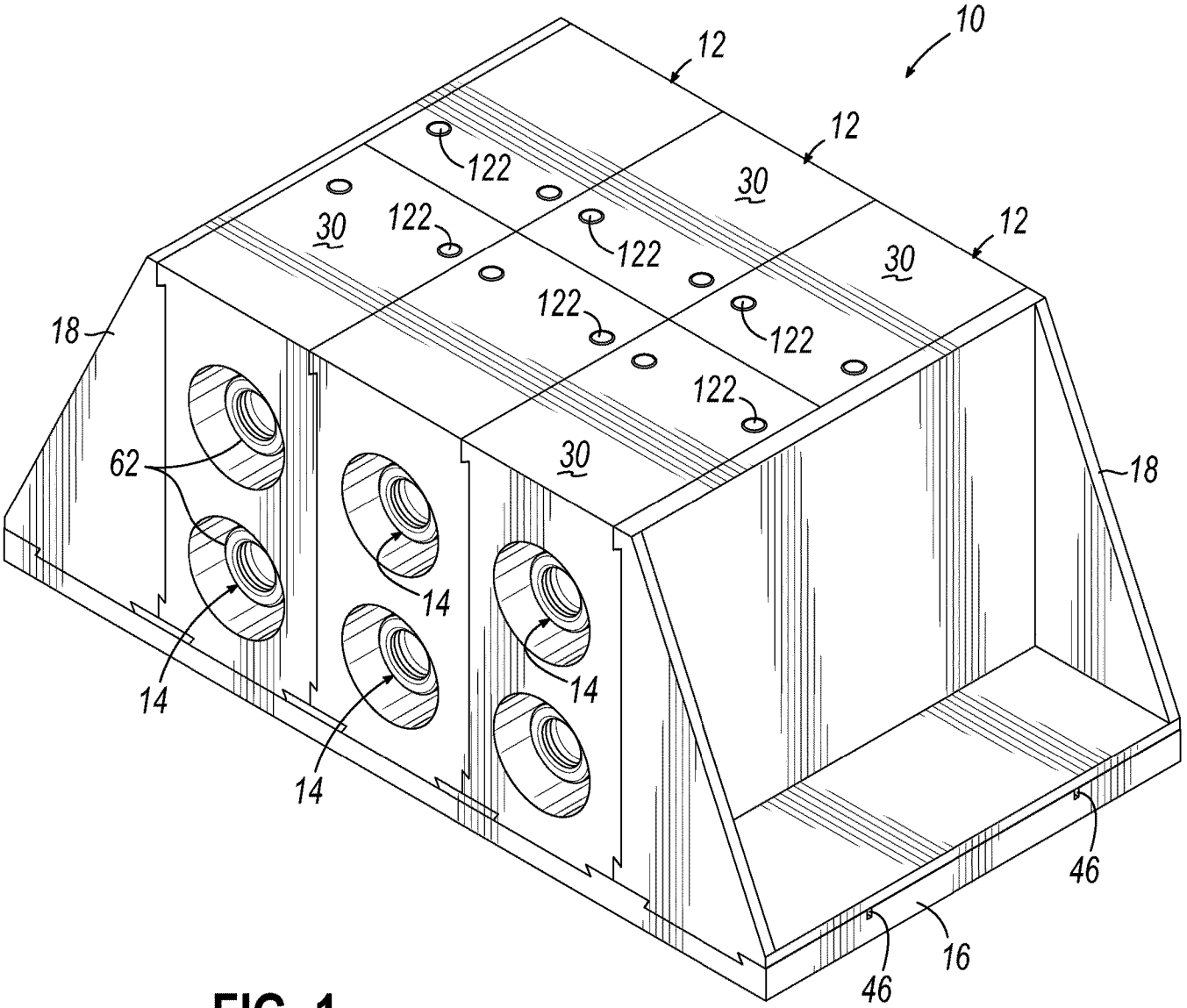
FIG. 1 is a perspective view of an embodiment of an electrical connection system in accordance with the invention.

FIG. 1 illustrates a quick connect electrical connector system/assembly 10 in accordance with embodiments of the invention. The system 10 provides the ability to quickly connect and disconnect electrical cables, such as power cables, within an overall power system. The invention has particular applicability with respect to aircraft power systems, but can be utilized for other systems and structures as well.

Figure 2:
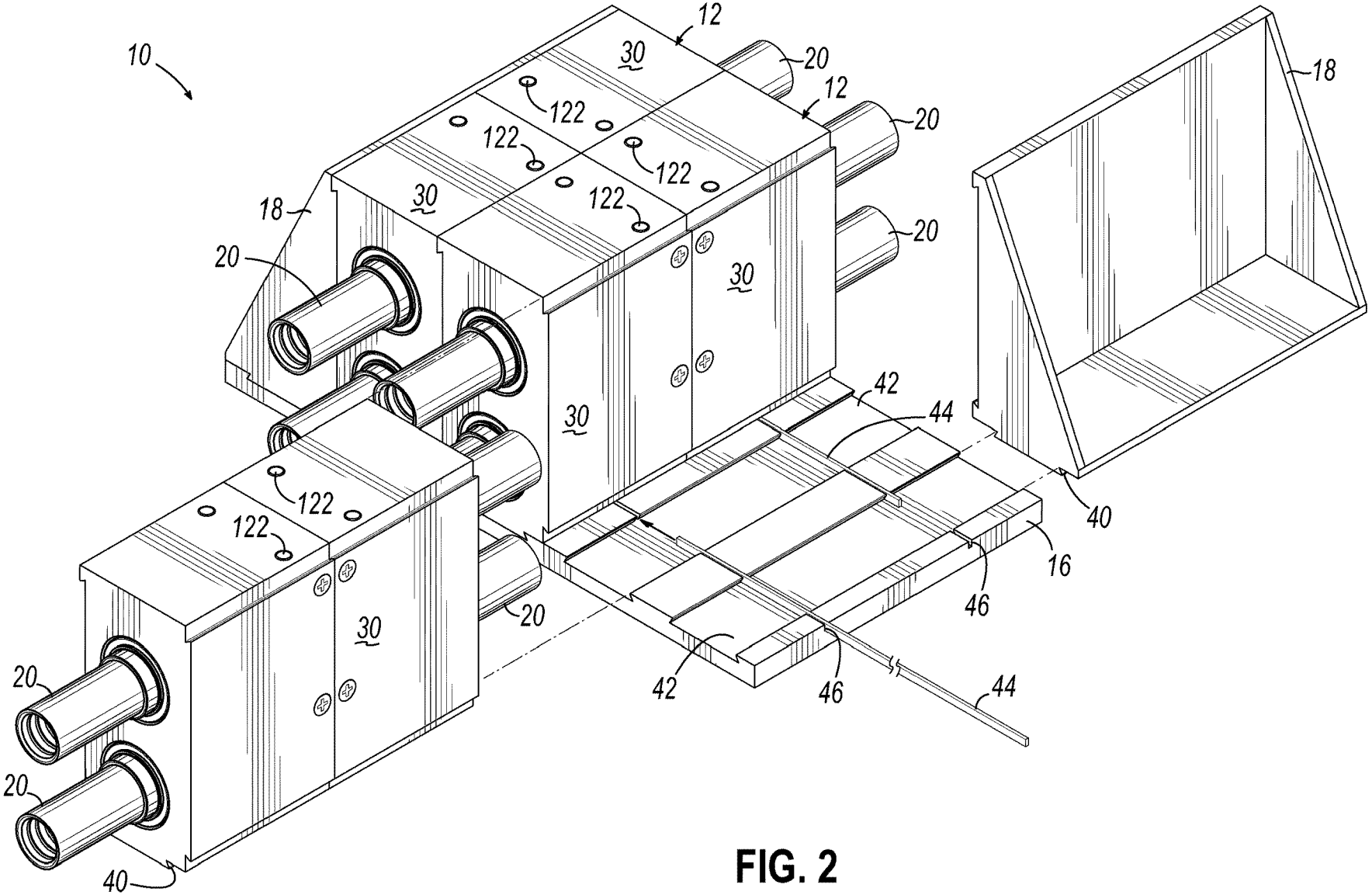
FIG. 2 is an exploded perspective view of an embodiment of an electrical connection system in accordance with the invention.
Figure 3:
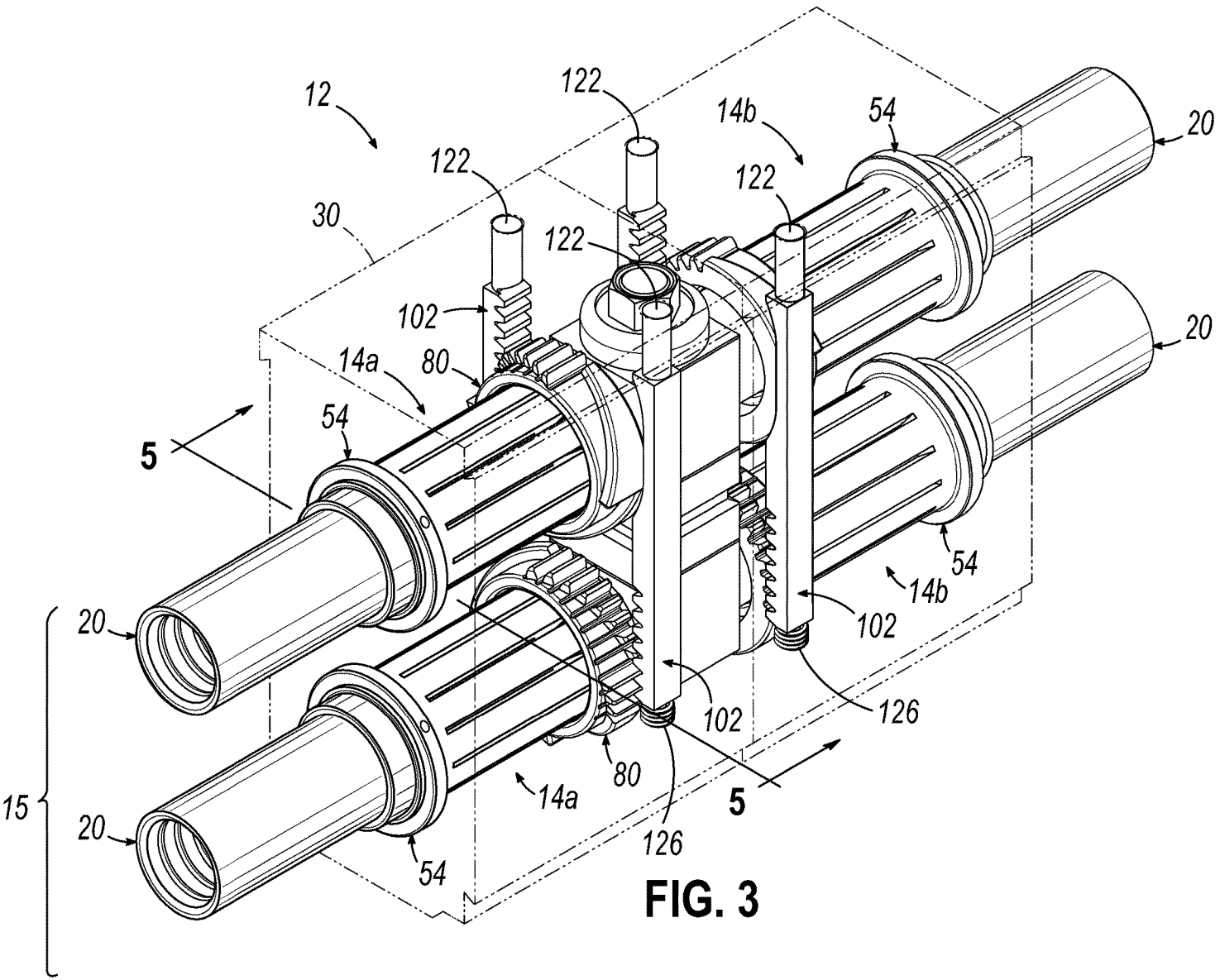
FIG. 3 is an internal perspective view of a module element of an embodiment of an electrical connection system in accordance with the invention.

System 10 includes a plurality of modules 12 that each include one or more electrical sockets 14. The sockets 14 are configured for accepting power cables and connectors and securing those connectors as described herein. The modules 12 and their respective sockets 14 may be incorporated together, such as on a base structure 16 and may be appropriately secured with the base structure as described herein. The plurality of modules 12 may be stacked side-by-side on the base structure 16 and the system 10 may include one or more modules. Each of the modules 12 may include one or more sets of sockets 14 for the desired connections. Generally, a connector is provided across the module from one socket 14 on an end of the module to a counterpart socket 14 on the other end of the module as shown in FIG. 3 for example. For purposes of completion of the system, such as for esthetics, and also for providing an access area for the mechanisms, such as a screw or a bolt that mounts the system 10, the system may incorporate one or more endcap structures 18 that also couple with base 16 and enclose the modules 12 to form the block assembly of system 10 as illustrated in FIGS. 1 and 2. While embodiments show a block assembly/system 10 having three independent modules 12, a greater or lesser number might be utilized and the base structure 16 may be sized appropriately. As such, the system can be modified and added to with the desired number of modules per a customer's specification and connector requirements. As discussed herein, each of the modules 12 incorporates the electrical sockets 14 and internal mechanisms as well as the mechanisms for locking and unlocking connectors and cables with respect to the system 10 as described herein.

Figure 1A:
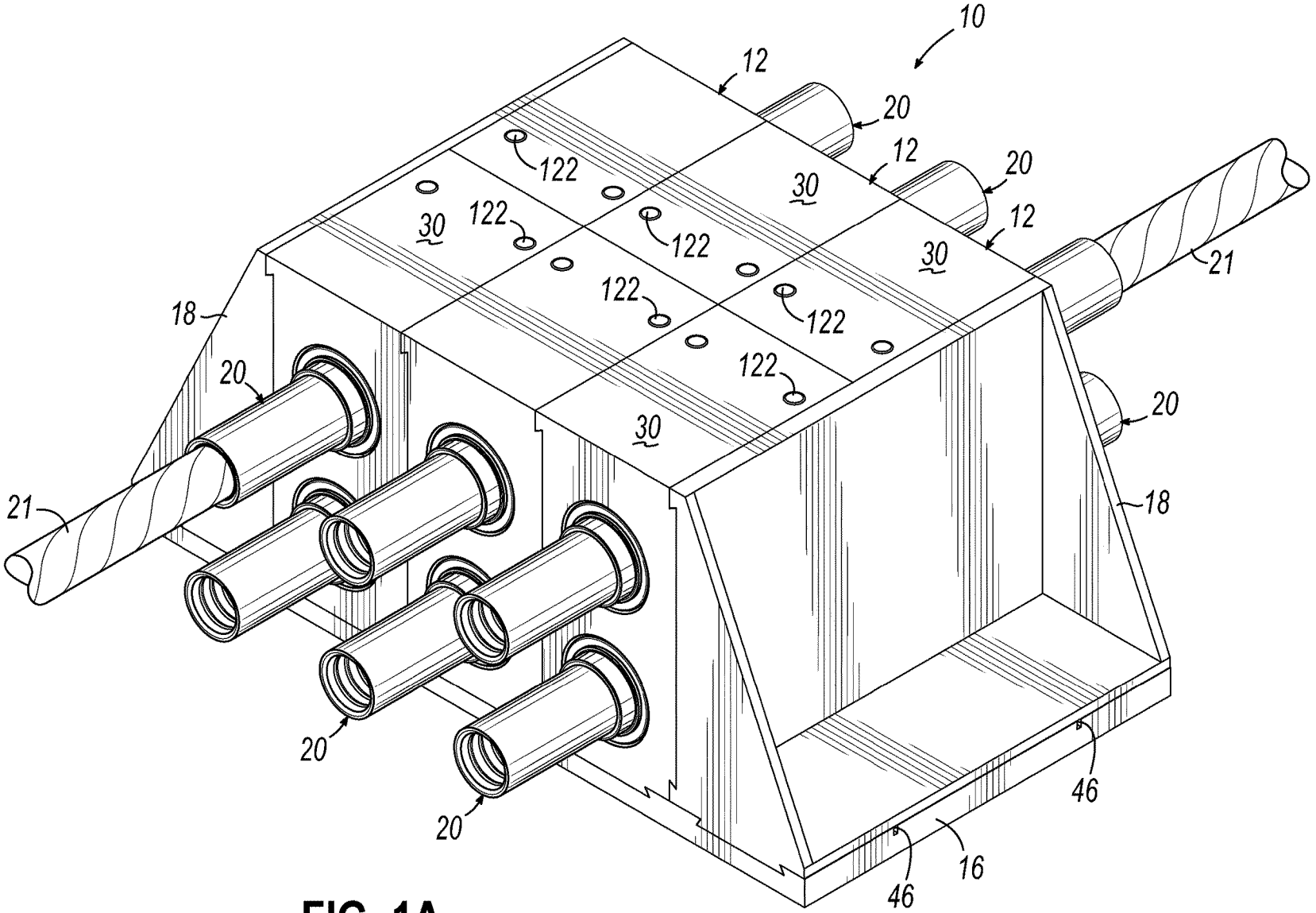
FIG. 1A is a perspective view showing connectors in the electrical connection system in the embodiment of FIG. 1.

FIG. 1A illustrates the assembly 10 of the invention having a plurality of connectors 20 plugged into the individual sockets 14. The various connectors 20 may be crimped or otherwise coupled with respective cables 21 to provide for electrical continuity through the connectors 20, the sockets 14, and through system 10 to sockets 14 and connectors 20 and cables 21 on the other side of the system as illustrated in FIG. 1A.

Figure 4:
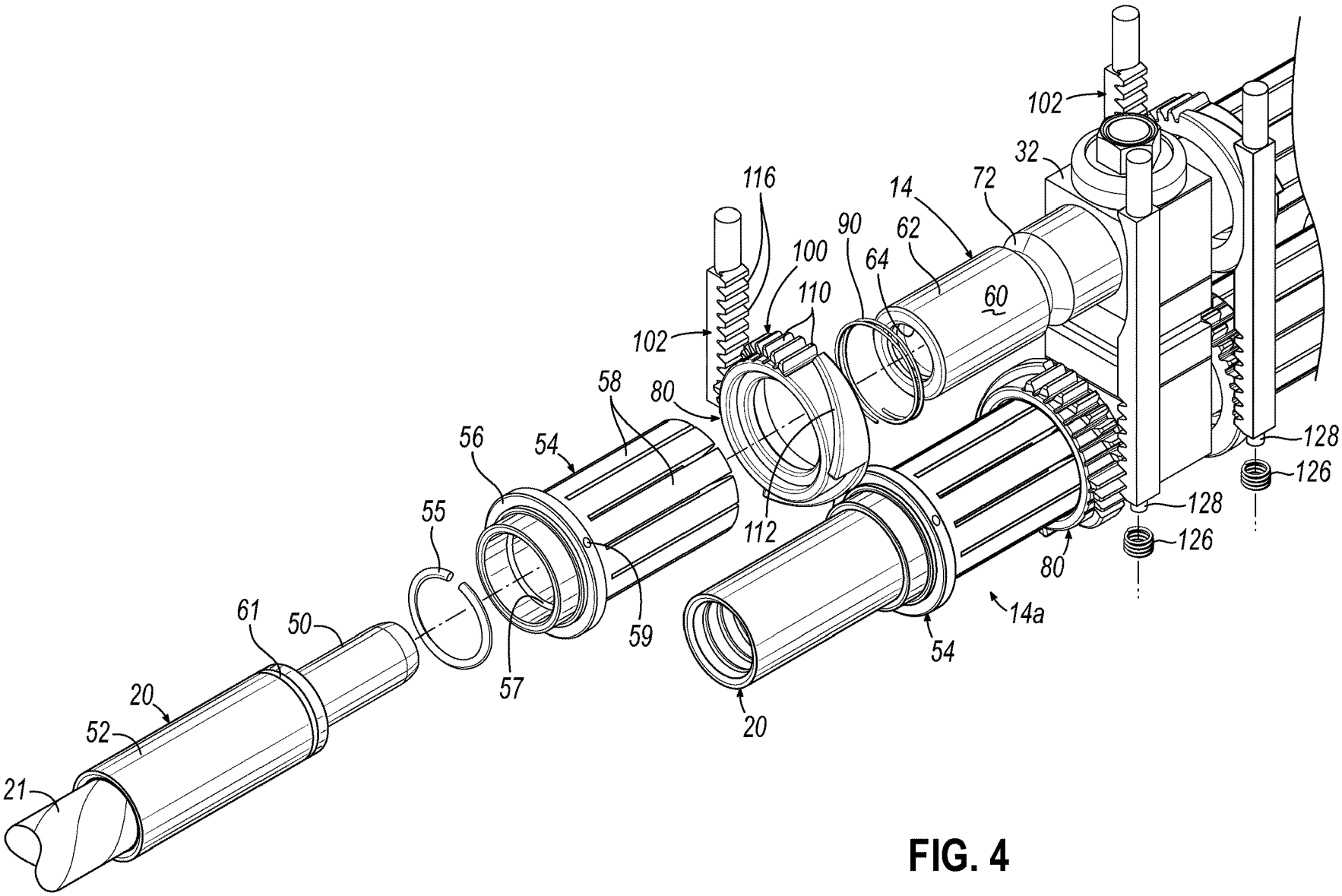
FIG. 4 is an exploded perspective view of a portion of the module element of FIG. 3 in accordance with the invention.
Figure 4A:
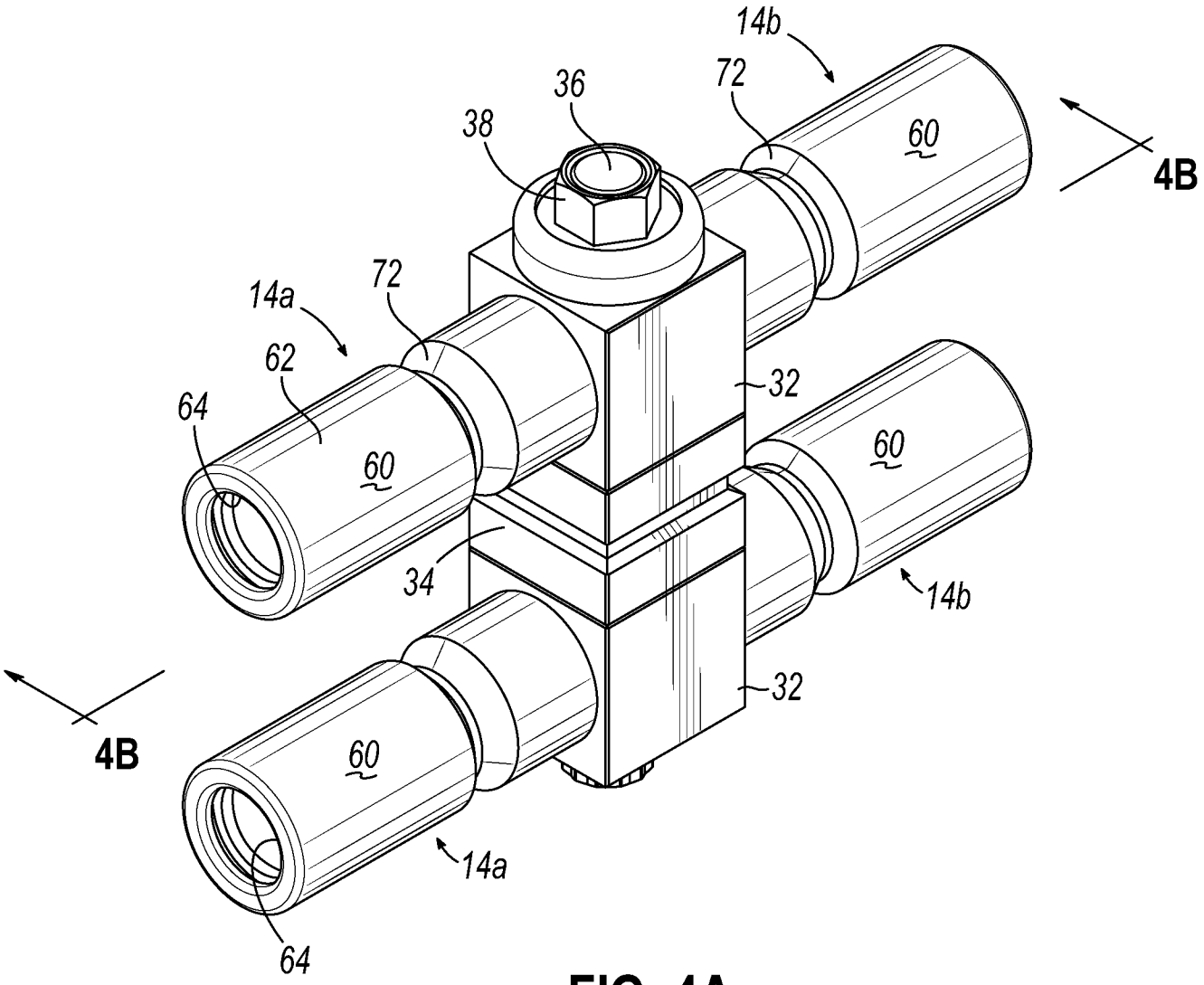
FIG. 4A is a perspective view of connector components of the module element of FIG. 3 in accordance with the invention.
Figure 4B:
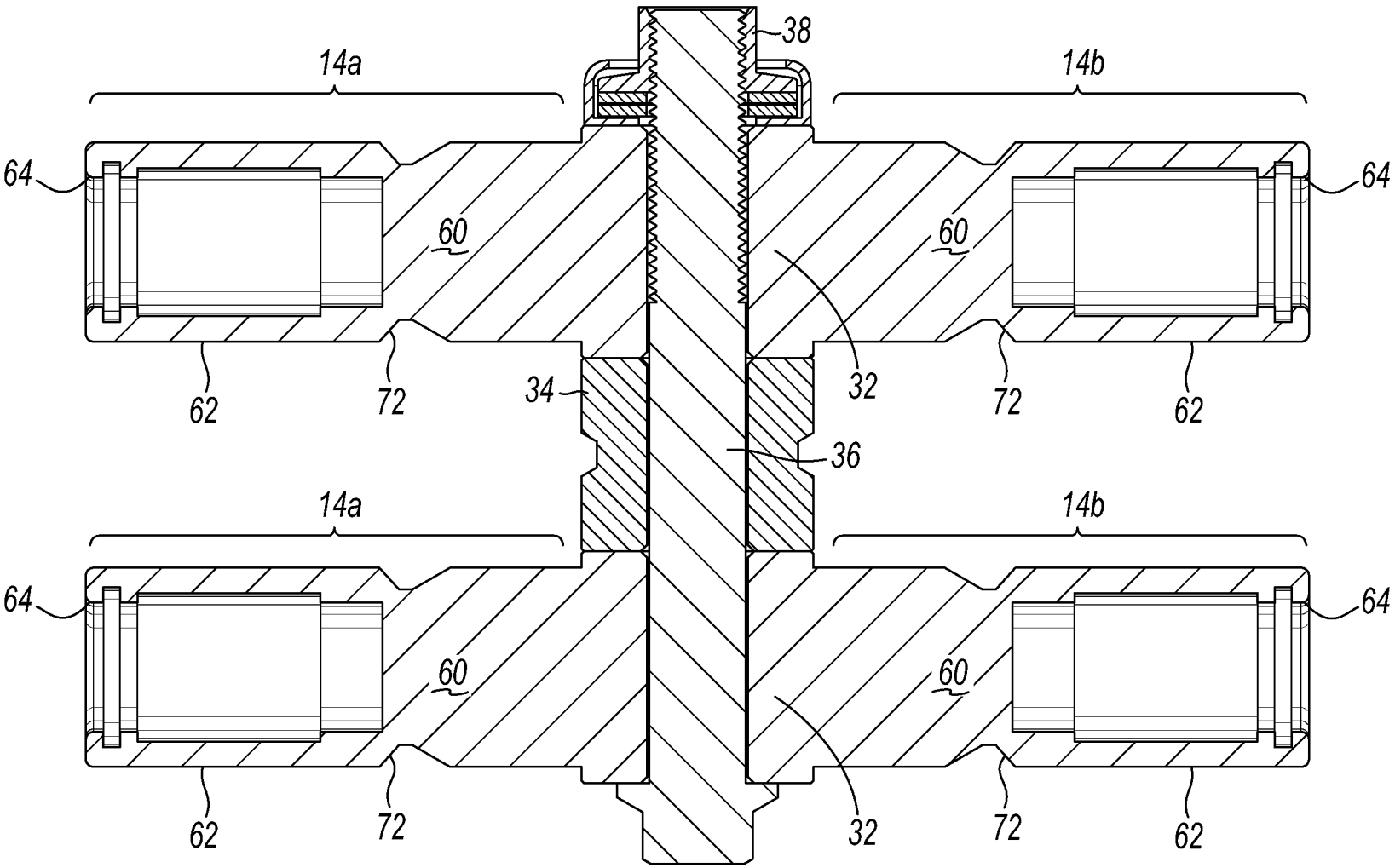
FIG. 4B is a cross-sectional view along lines 4B-4B of the connector components of FIG. 4A in accordance with the invention.
Figure 4C:
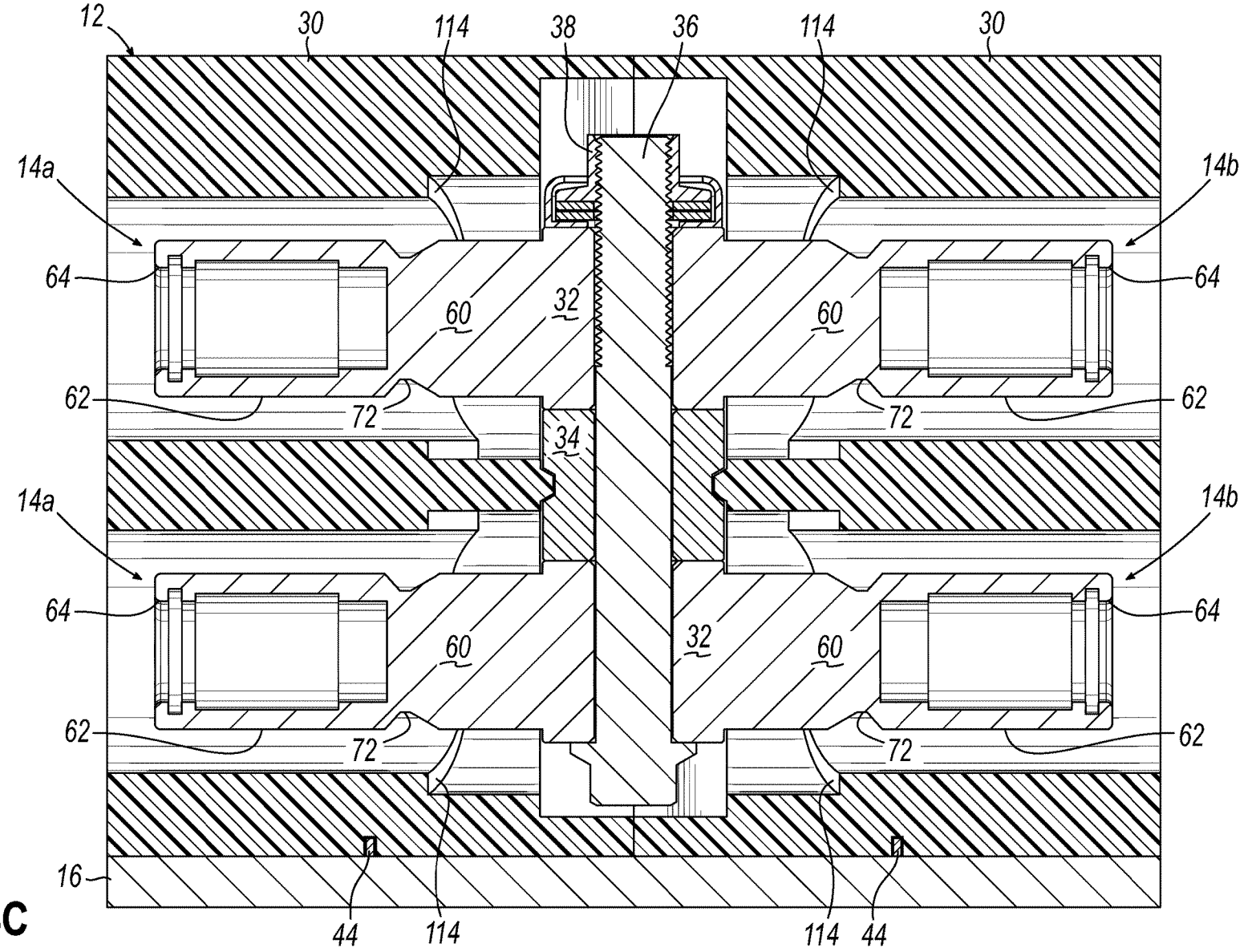
FIG. 4C is a cross-sectional view of a portion of the module element of FIG. 3 in accordance with the invention.

The modules 12 contain the sockets 14 and other mechanisms as described herein for providing an electrical connection through the module 12 as well as securing one or more of the connectors 20 and respective cables 21 in the modules 12 as illustrated in FIG. 1A. To that end, the modules 12 each include a body 30 that may be formed of an appropriate plastic or other insulating material, such as a polyamide-imide (PAI) material (e.g. Torlon). The body 30 encloses the various sockets 14, which may be formed as part of a continuous electrical structure from end-to-end across the module for providing electrical continuity across the module. For example, referring to FIGS. 4A and 4C, socket structures 14 are illustrated formed together in a four socket block that might be incorporated into each module 12. As shown in FIG. 4A, the sockets 14 are arranged in pairs 14*a*, 14*b* which are coupled together, end-to-end through an intermediate section 32 for forming a socket assembly. The internal structures of the sockets 14 provide electrical continuity in each of the socket pairs and may then be coupled together through a conductive element 34 and an appropriate bolt structure 36. The bolt structure or other fastening structure extends through each of the socket intermediate sections 32 as well as the conductive structure to secure sockets together and form a unitary and conductive four socket block as shown in FIGS. 4A-4B. That block may than be encased or enclosed within each module body 30, as illustrated in FIGS. 2 and 4C. The conductive element 34 may be formed of an appropriate material such as electrical grade copper or aluminum, for example. The sockets 14 as well as intermediate section 32 may be formed of an appropriate conductive metal, such as electrical grade copper or aluminum, for example. Plugging a connector 20 and cable 21 into each of the sockets 14 will provide electrical continuity across the module to other respective sockets 14, connectors 20 and cables 21 as desired. (See FIG. 1A.)

Referring again to FIG. 2, for securing the modules 12 into the system 10, one embodiment of the invention might utilize a dovetail joint as shown. Specifically, each of the modules 12 and base structure 16 includes one half of a dovetail joint, such as the dovetail 40 or the slot 42 receiving the dovetail. As illustrated in FIG. 2, the modules 12 are illustrated with the dovetail 40 whereas the base structure 16 is illustrated with the shaped slot 42. However, an opposite configuration may be utilized for securing the modules 12. More specifically, each of the modules 12 and their respective dovetail 40 is slid into a receiving slot 42 within the base structure 16. One or more locking structures 44 slide within appropriately formed grooves 46 within the base structure 16 and engage with each of the dovetails 40 of the modules to secure the modules within the base structure 16. As illustrated in FIG. 2, the locking structures 44 are slid through the appropriate slots 46 in the base structure 16 and into engagement with each of the modules. Then, for securing the locking structures 46 and further securing the modules 12 within the base structure 16, the end cap structures 18 may be put into place. The base structure 16 and end cap structures 18 may be formed with appropriate bolt holes, snap mechanisms, or other structures for mounting the system 10 to a structure, such as an appropriate aircraft structure depending upon the use of system 10.

Referring to FIG. 4C, a cross-sectional view is shown of the module 12 with the sockets 14 formed therein. As illustrated in FIG. 4C as well as FIG. 1, the sockets 14 are recessed within the body 30 of each module 12 and the four socket block as illustrated in FIG. 4B is encased or otherwise secured within the module 12 to prevent movement of the sockets 14 and other hardware. The bolt 36 and locking washers 38 hold the socket assemblies together with the conductive structure 34. Then the socket assemblies are secured with the bodies 30. For example, grooves (not shown) formed in the conductive structure 34 may mate with corresponding keys (not shown) in the body elements 30 or other body or filler blocks to hold the socket assemblies in place within the bodies 30. As further discussed herein, the internal structures of body 30 also form surfaces proximate to each socket that act as part of a mechanism for locking and unlocking connectors in the sockets.

The socket assemblies including the connectors 20, intermediate sections 32 and conductive structure 34 are thus coupled together to form a conductive block or module 12 of connectors as shown. Each of the connectors of the module 12 is electrically coupled with another module. In that way, various power cables for power feeders may be coupled together in the module 12 for front-to-back connections, front-to-front (or back-to-back) connections. Also, various power cable arrangements may be accommodated. There may be one front cable to one back cable arrangement (one cable on each side of the module), as well as one front cable to two back cable arrangement (or vice versa). There might also be one front cable to another front cable arrangement (or vice versa on the back side). Finally, all the sockets might be use with an arrangement of two cables on each side of the connector system.

In accordance with another embodiment of the invention, the system 10 provides a quick connect and disconnect for securing and removing connectors 20 and cables 21 within system 10. To that end, referring to FIGS. 3 and 4, each connector 20 plugged into system 10 may incorporate a pin or plug portion or plug 50 which plugs into a socket 14 and a crimp portion or interface portion 52 which interfaces with the cable 21. The crimp portion 52 may incorporate various structures, such as illustrated in U.S. Pat. No. 9,385,449, which is incorporated herein by reference, for coupling with a cable. The connector 20 interfaces with a conductor or wire of the cable 21. Each connector 20, in accordance with one feature of the invention, includes an insulating connector shroud 54 that covers part of the connector 20 including the plug 50. The insulating shroud 54 may be formed of an appropriately insulative plastic material, such as PAI as noted herein. Referring to FIG. 4, the shroud 54 includes a base 56 for interfacing with a portion of the connector 20 (see FIGS. 5A, 5B) and a plurality of spring fingers 58 extending from the base to cover the plug 50. In accordance with a feature of the invention, the shroud 54 is configured for engaging socket 14 and locking the connector 20 with the socket 14. More specifically, referring to FIG. 4, the socket 14 includes a body structure 60 having a plug-receiving portion 62 with an appropriate opening 64 for receiving the plug 50 of connector 20.

Figure 7A:
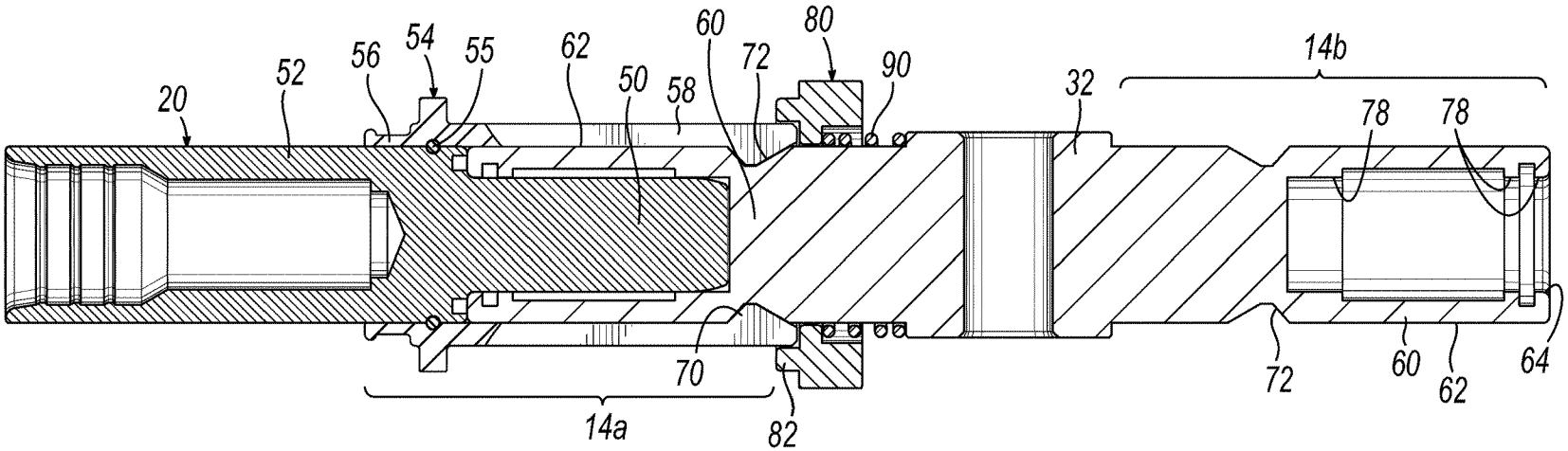
FIGS. 7A-7B are cross-sectional views of a connector and socket interaction of an embodiment of an electrical connection system in accordance with the invention.
Figure 7B:
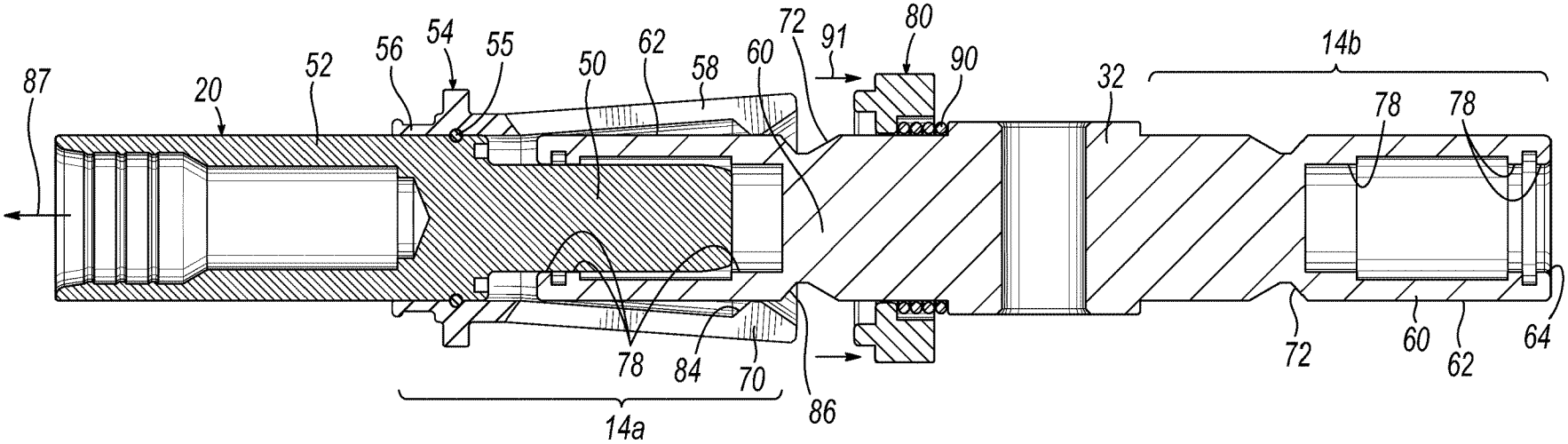

Referring to FIGS. 7A and 7B, the shroud 54, and particularly the spring fingers 58 are dimensioned to overlie the plug-receiving portion 62 of socket 14 when connector 20 and plug 50 are plugged into the socket. The shroud 54 locks connector 20 and plug 50 with respect to socket 14. To that end, referring to FIGS. 7A and 7B, each of the spring fingers 58 incorporate a flange portion 70 which protrudes radially inwardly with respect to the spring fingers 58 and shroud 54. The flange portion 70 collectively form a spring-biased flange structure circumferentially around the shroud 54 as illustrated in FIGS. 7A and 7B. More specifically, the spring fingers of the shroud 54 extend circumferentially around the shroud such that the flange portions 70 effectively form a circumferential flange structure that extends around the inside of the shroud as shown in FIG. 7A. This flange portions 70 and collective flange structure engage a groove 72 formed around the body 60 of socket 14. Referring to FIG. 4, the groove 72 is positioned toward one end of the socket 14 behind the plug-receiving portion 62. To that end, the flange portions 70 of shroud 54 are positioned at the end of the spring fingers 58. In that way, the shroud 54 and connector 20 are secured on the socket 14 with the plug 50 held securely within the plug-receiving portion 62 of the socket.

Referring to FIG. 7B, the spring fingers flex radially away from the socket body and specifically away from the pin receiving portion when the connector plug is inserted into the socket to allow the shroud 54, and particularly the lock portions 70 on the spring fingers 58 to fit over the plug-receiving portion 62 of socket 14. As illustrated in FIG. 7B, the spring fingers 58 are shown flexed with the lock portions 70 riding on an outer surface of the plug-receiving portion 62. When connector 20, and particularly, plug 50 is inserted further into socket 14, the lock portions 70 under the spring bias of the spring fingers 58 will flex radially inwardly to drive the lock portions 70 into the groove to engage the groove 72. As may be seen in FIGS. 7A and 7B, the plug-receiving portion 62 of the socket 14 has a number of alignment surfaces 78 for aligning the plug in the pairs of sockets 14*a*, 14*b*. While one shape and type of plug 50 and plug-receiving portion 62 are illustrated, the invention is not limited to the types of connector structures that might use the features of the present invention. Furthermore, there may be additional conductive structures or inserts that might be used in the plug-receiving portion or with the plug for ensuring a robust electrical connection between the cables 20 and system 10. As shown, the structure forming pairs of sockets 14*a*, 14*b* and intermediate section 32 might be formed as a unitary structure and a plurality such unitary structures may be stacked together and held together by a fastener as illustrated in FIGS. 4A-4C for forming a module in accordance with the invention.

In accordance with another feature of the invention, the system can include the collar that is slidably mounted on the conductive socket 14. The collar is configured for sliding between a locked position proximate to the socket groove 72 and an unlocked position away from that socket groove. More specifically, the collar 80 is illustrated in FIG. 7A in the locked position and is illustrated in FIG. 7B in the unlocked position. In the locked position, the collar 80 is further configured for engaging the spring fingers 58 and particularly for engaging the lock portions 70 of the connector shroud to hold the finger lock portions engaged with groove 72 to lock the shroud and connector 20 in the socket, as illustrated in FIG. 7A. Particularly, collar 80 includes some portion thereof, such as ridge 82, that overlies the lock portions 70 and part of the groove 72 and prevents the lock portions 70 and the spring fingers 58 from rising on the socket 14 so that the lock portions 70 stay locked into groove 72. In that way, as illustrated in FIG. 7A, the spring fingers 58 cannot flex radially away from the socket 14. In that way, the connector 20 and connector plug 50 are maintained plugged into the socket.

In order to then remove the connector 20, the collar is configured to move to the unlocked position generally away from the socket groove 72. This frees the end of the fingers and the lock portions 70 such that the fingers 58 may flex fully away from the socket. The lock portions 70 may then move out of the groove 72 so that the connector, including the plug 50 and shroud 54 may be removed from the socket 14. For the purposes of engagement and disengagement for locking and unlocking the connector shroud and the connector, the lock portions 70 may include angled surfaces 84 that are complementary to respective angled surfaces 86 of the groove 72. In that way, when the connectors pull rearwardly away from the socket as illustrated by arrow 87 in FIG. 7B, the lock portions 70 will slide up and out of the groove 72 through the interaction of the complementary angled surfaces 84 and 86. Then the connector plug 50 may be unplugged from the socket 14 and removed. In connecting the connector 20 with the socket 14, the connector plug 50 is plugged into the socket opening 64 with the spring fingers traveling over plug-receiving portion 62 so that the lock portions 70 slide along and fall into the groove 72.

In accordance with another aspect of the invention, the collar 80 is biased towards the groove 72 or toward its locked position, as illustrated in FIG. 7A. To that end, a spring mechanism 90, or other biasing element, may act on collar 80 to bias the collar forwardly toward the groove 72 and to the locked position as shown in FIG. 7A to engage the spring fingers 58. The spring mechanism may act between the collar and a portion of the socket 14 or intermediate section 32 for biasing the collar. Then, to unlock the connector and connector shroud 54, the collar has to be moved to an unlocked position away from the socket groove 72 against the bias of spring mechanism 90 or other biasing element. To that end, in accordance with another aspect of the invention, a mechanism is utilized for acting on the collar 80 for moving the collar from the locked position to the unlocked position. Specifically, the mechanism, when acting on the collar, will slide the collar toward the unlocked position as illustrated in FIG. 7B and shown by arrows 91. In that way, the spring fingers 58, and particularly the lock portions 70 thereof flex radially outwardly and away from the socket groove 70 for the removal of the connector and shroud 54.

When the connector is plugged into the socket initially, the collar 80 will be biased toward the locked position, as shown in FIG. 7A. In that position, the spring fingers, and particularly the lock portions 70, would be prevented from flexing radially inwardly and into the groove 72, because the collar 80 would be obstructing a portion of the groove. The outwardly flexed fingers, as illustrated in FIG. 7B, engage the collar as the connector plug is plugged into the socket and thereby push collar 80 rearwardly toward the unlocked position as shown in FIG. 7B. At the same time, the lock portions 70 engage groove 72. Then, when the collar 80 has been pushed rearwardly a sufficient distance to expose the groove, the spring fingers 58 flex radially inwardly with the lock portions 70 sliding into the groove 72. The collar is then no longer pushed to the unlocked position by the shroud. Under the bias of spring mechanism 90, the collar 80 can again slide forwardly, over the spring fingers 58 of the shroud to the locked position as shown in FIG. 7A. The collar then locks the spring fingers 58 as shown because the collar can slide over the spring fingers 58 of the shroud.

Referring to FIG. 4, one embodiment of the mechanism for moving the collar is illustrated. The illustrated embodiment is in the form of an interactive pinion gear 100 and rack gear 102. More specifically, in the illustrated embodiment, the pinion gear 100 is incorporated with the collar 80. The collar is configured and positioned within the module body 30 to not only slide or translate between the locked and unlocked positions as shown, but also to rotate with respect to the socket 14. The rotation of the collar 80, also slides or translates the collar over the socket 14 under the operation of the mechanism. More specifically, translation of the rack gear 102 up and down acts on the pinion gear 100 and collar 80 and imparts the rotation of the collar 80 through that pinion gear. The rotation moves the collar 80 from the locked position to the unlocked position.

As illustrated in FIGS. 3 and 4-4C, the various sockets 14 are contained within a body or housing 30 forming the various modules 12. Each socket includes a respective collar 80 associated with the socket and slidably mounted with respect to the socket. The collars each include respective pinion gears 100. The pinion gear is reflected in a plurality of gear teeth 110 that are positioned circumferentially around at least part of the collar 80. Additionally, as illustrated in FIG. 6B, the collar 80 includes one or more cam surfaces 112 adjacent to the teeth 110. Described herein, the teeth 110 and cam surfaces 112 operate with complementary cam surfaces 114 that are formed within the body 30 of the modules 12 proximate to the collars for engagement with the teeth 110 and surfaces 112. The interactive pinion gear 100, rack gear 102, teeth 110 and cam surfaces 112, 114 act together to provide a mechanism for moving the collar between a locked and unlocked position.

In one embodiment of the invention, in addition to the cam surfaces 112 on the collar, the teeth 110 are also configured to form a cam or cam surface. Specifically, referring to FIGS. 4 and 6A, the teeth 110 on collar 80 have different lengths progressing circumferentially around the collar and forming the pinion gear 100. Longer teeth 110 progressing to shorter teeth form a cam surface as illustrated in FIG. 4 and particularly FIG. 6A. The cam surfaces 112 and gear teeth cam surfaces extend around the circumference of the collar 80. The gear teeth 110 of the pinion gear 100 and the cam surface formed thereby are positioned in the module body 30 to engage one or more complementary cam surfaces 114 formed in the module. So the collar cam surfaces 112 and pinion gear 100 act together to move the collar. Particularly, in a portion of the body 30 that houses the electrical connector system and elements, the complementary cam surfaces 114 might be formed around the socket 14 forwardly of the collar as illustrated in FIG. 6A to abut against the respective cam surfaces 112 and gear teeth 110 of the collar.

Figure 6A:
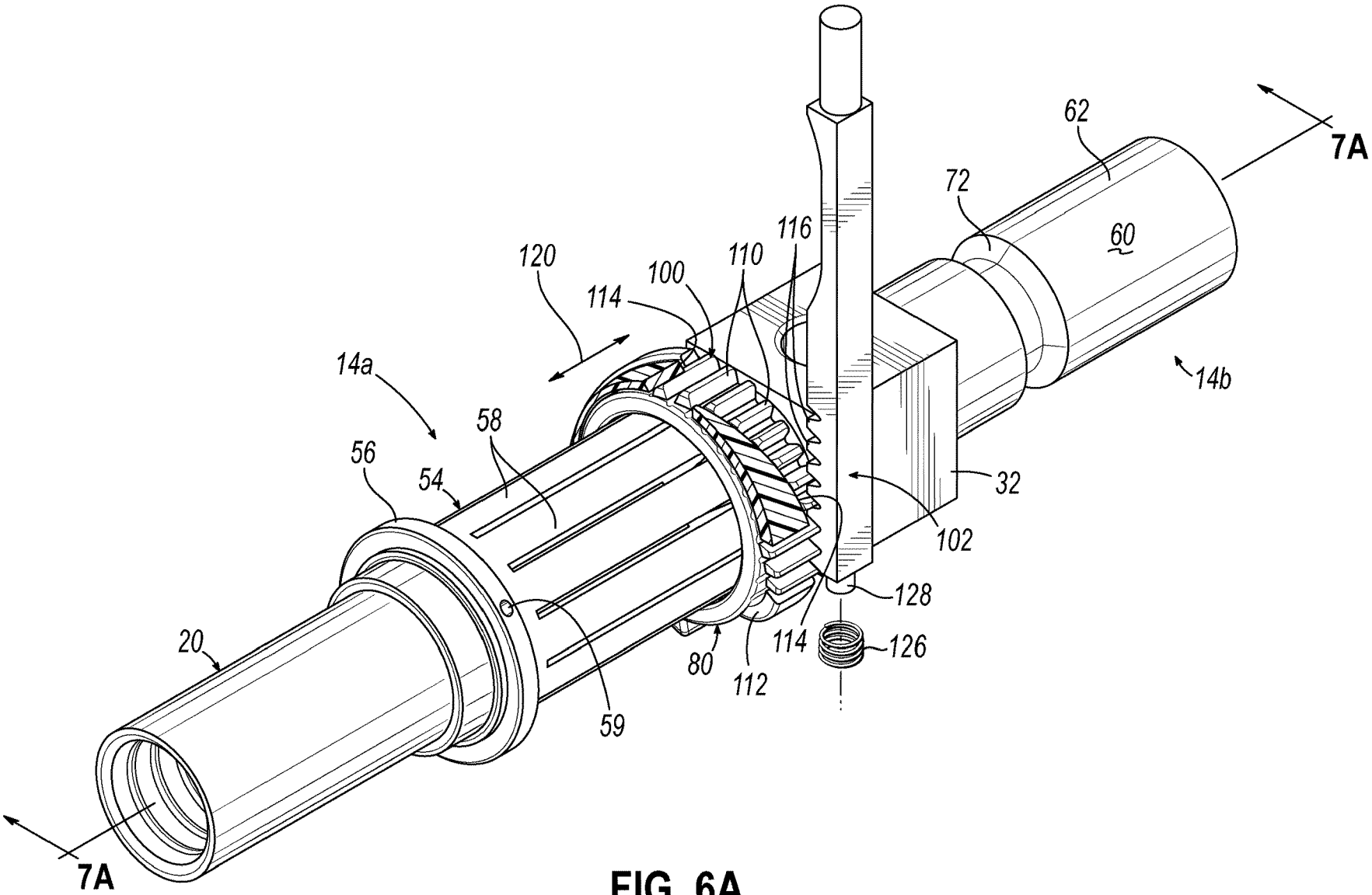
FIGS. 6A-6B are perspective views of a connector and socket interaction of an embodiment of an electrical connection system in accordance with the invention.
Figure 6B:
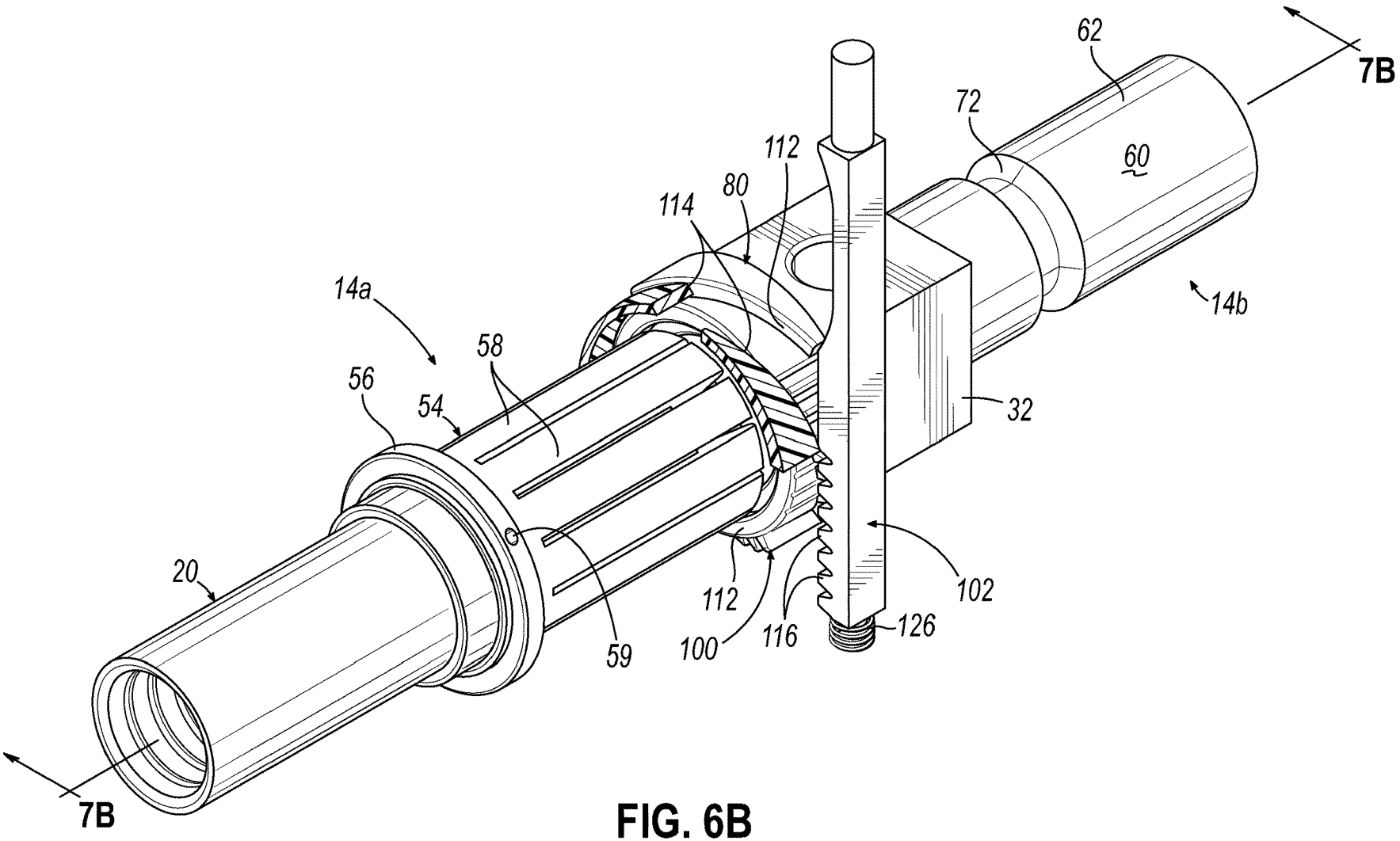

For engagement with the pinion gear teeth 110, the rack gear 102 also includes engaging teeth 116 as shown in FIGS. 6A-6B. FIGS. 6A and 6B show translation of the rack gear 102 in accordance with the invention and the engagement with and rotation of the pinion gear 100 and collar 80. As the rack gear 102 is translated and engages the pinion gear 100 and teeth 110, the collar 80 is rotated. That rotation slides the cam surfaces 112 and the cam surface of the teeth 110 of the collar 80 against the respective module cam surfaces 114 formed in the body 30 of the module 12. The various cam surfaces form inclined surfaces along their length that are inclined along the circumference of the collar and in the longitudinal dimension of the collar 80 as illustrated by arrow 120 in FIG. 6A. As such, rotation of collar 80 and the engagement of the cam surfaces 112 and teeth 110 with cam surfaces 114 of the module, longitudinally translates the collar 80 in the module 12 with respect to the connector socket 14. As shown in FIGS. 7A and 7B, the collar thereby moves longitudinally on the socket 14 from the locked position as illustrated in FIG. 7A to the unlocked position as illustrated in FIG. 7B. In that way, the shroud 54 may be unlocked in order to remove the connector and plug from the socket 14 as discussed.

Referring to FIG. 3, the various sockets and slidable collar elements are contained within body 30 and within appropriate cavities and structures therein for supporting those various elements of the electrical connector system. As noted, in one embodiment, the body 30 of the module is configured and formed to create and position the complementary cam surfaces 114 proximate to the various collars 80 so the cam surfaces can act upon the collar. As may be appreciated, the module body 30 may be molded or otherwise fabricated to receive the socket structure as shown in FIGS. 4A-4C to make a complete module as illustrated in FIG. 1. Module 12, as shown in FIG. 3, might incorporate four sockets and the various mechanism elements (e.g. cam surfaces 114) for moving the collars between the locked and unlocked positions. Appropriate spaces are formed in the module body 30 to support the sockets and collars as well as the various pinion and rack gears and the biasing elements 90, 126. Specifically, the rack gears 102 are supported in a way so as to be translated up and down as shown in FIG. 3. To that end, each of the rack gears 102 includes engagement portions, shown in the form of pins 122, that may be pushed downwardly for translating the rack gear 102 and turning the pinion gears 100 and collars 80 to rotate on the sockets 14. Referring to FIG. 3, in one embodiment of the invention, a pair of sockets 114 may incorporate rack gears 102 that are positioned on opposite sides of the module 12. To that end, translation of the opposing rack gears 102 will rotate the respective pinion gears and collars in opposite directions for a particular socket pair as illustrated in FIG. 3. As such, the cam surfaces 114 are configured so that their respective inclined surfaces extend in opposite directions to each other within a socket pair 14 in the module. Similarly, on the opposing side of the module, the sockets might be similarly arranged in a pair with collars 80 also rotating in opposite directions. That is, while one collar rotates in a clockwise direction based upon the engagement of rack gear 102, the other collar will rotate in a counterclockwise direction based upon engagement with the opposing rack gear 102.

In accordance with another feature of the invention, each of the rack gears 102 might be biased with an appropriate biasing element 126, such as a spring element, as illustrated in FIG. 3. Particularly, each of the rack gears 102 also includes an appropriate portion 128 that engages the biasing element 126 so that the biasing element acts on the rack gear. The module body may contain the biasing element 126 in alignment with the rack gear portion 128. The biasing element as illustrated in FIGS. 3 and 4 may bias each of the rack gears 102 in an upward position. To that end, the biasing element would be positioned between an appropriate surface or portion of the interior of the body of module 12 so as to act on portion 128 and the rack gear 102 to bias it vertically upward. This, in turn, will bias the collar and pinion gear to rotate in a certain direction so that it may move to the locked position as disclosed. Engagement of the button portion 122 will then push downwardly against bias element 126 for activating the mechanism that rotates the collars 80. In that way, the bias element 126 operates with biasing element 90 for moving the collar 80 to the locked position.

The mechanism of the invention for acting on the collar is multi-functional including both the action to rotate the collar as well as the action to translate the collar along the socket to move it from the locket position to the unlocked position. The action on rack gear 102 in pushing the button portion downwardly thereby operates against the force of both the biasing element 90 and the biasing element 126 to rotate the collar and translate the collar to the unlocked position as illustrated in FIG. 7B. Upon release of the button portion 122, the biasing elements 90 and 126 again act and ensure that the collar 80 is rotated back to the locked position. That is, the biasing element 126 operates to translate the rack gear 102 to rotate the collar while the biasing element 90 operates to translate the collar 80 and the cam surfaces thereon against the complementary cam surfaces of the module body thereby providing a further force for rotating collar 80 so that it can move back to the locked position of FIG. 7A. Of course, the invention might also just use one of the biasing elements 90, 126 for providing the bias forces to bias the collar at rest to the locked position.

In accordance with one aspect of the invention as illustrated in FIGS. 1-3, the button portions 122 of the rack gears may be recessed within the body 30. In that way, a tool might have to be utilized to engage the button portions 122 and drive them downwardly into body 30 to translate the rack gear 102. In an alternative embodiment of the invention, some section of the pin portion 122 may extend above body 30 of each of the modules 12 to be engaged more readily manually engaged without the use of a tool.

Therefore, in accordance with the operation of the invention, a connector and a connector plug may be plugged into the conductive socket 14 with the shroud 54 acting on collar 80 to push it back to the unlocked position as illustrated in FIG. 7B. Upon full insertion of the connector or at least sufficient insertion of the plug 50 to allow the lock portions 70 to engage groove 72, the collar 80 may be free to rotate and slide back to the locked position under the bias of biasing elements 90 and 126. Accordingly, for plugging in the connector and locking it within the electrical connector system 10 of the invention, a person only has to plug the connector in to the socket of the module. The rotational and translational movement of the locking collar 80 occurs automatically from the force on the connector and associated shroud. Once locked, the connector cannot be removed due to the operation of the shroud holding the connector plug 50 in socket 14. However, upon the desire to unplug a connector, one or more of the button portions 122 may be engaged to drive the rack gears and rotate the pinion gear to provide rotation and subsequent translation of one or more collars 80. When moved to the unlocked position, the collar is free of the lock portions 70 and groove 72 and the spring fingers 58 of the shroud 54 are free to again flex so that the locking portions 70 may slide out of the groove 72. This allows the plug of the connector to be unplugged from the socket for removal of the connector. Accordingly, the invention provides desirable locking mechanism for the connector once it is plugged into a module 12.

Figure 5B:
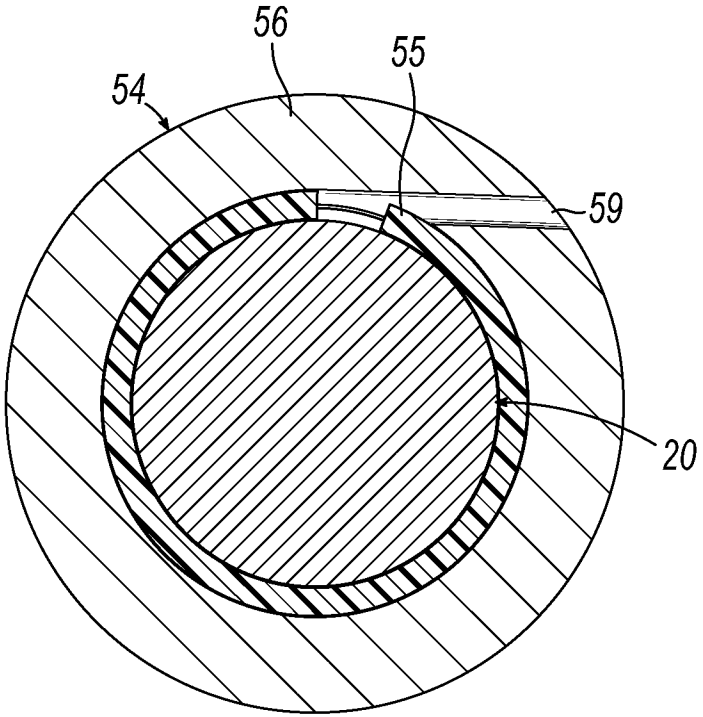
FIGS. 5A-5B are cross-sectional views of shroud elements of an embodiment of an electrical connector in accordance with the invention.
Figure 5A:
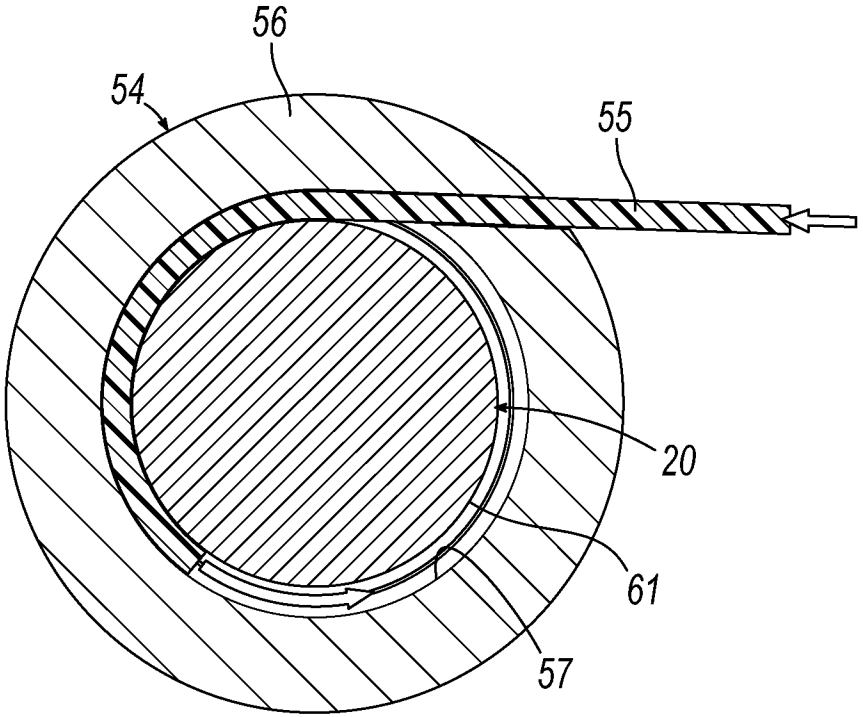

In accordance with another feature of the invention, the shroud 54 is removable and replaceable with respect to the connector 20. That is, the shroud is replaceable without having to cut off or re-terminate the entire connector or other end fitting of the cable. To that end, the shroud may be formed of a plastic material that may be cut off or broken to remove it from the connector and install a new shroud. The shroud is secured with an element that remains with the broken shroud and a new shroud may be readily installed on the same connector 20. Referring to FIGS. 4 and 5A, the shroud assembly includes the shroud 54 and a cord lock element 55 that is inserted into the shroud to engage the connector 20. More specifically, the shroud 54 includes a cord passage 57 that encircles the shroud and is accessed through opening 59. The connector 20 has a corresponding groove 61 that is positioned on the connector 20 to coincide with the shroud passage 57. The passage might be positioned in the base 56 of the shroud, for example. The shroud may be placed on the connector and abuts against the end of the plug 50 so that the cord passage overlies the groove. As may be appreciated, the shroud and connector may be formed and dimensioned, such as in diameter, so that when they come together as shown in FIG. 4, the passage overlies the groove. As shown in FIGS. 5A and 5B, the cord lock element can then be slid into the passage 57 through opening 59 and directed to encircle the passage and engage the groove 61 in the process. The passage 57 and groove 61 overlap and both simultaneously engage the cord lock element 55. This then secures the shroud with the connector. Preferably, the cord lock element 55 is dimensioned to surround most of the passage and groove to secure the shroud. In one embodiment, a length of cord lock element may be pushed into the passage as shown in FIG. 5A and then broken off proximate the opening 59 when it fully encircles the passage 57. In that way, the shroud is secured. If the shroud is then later cut or broken away, without affecting the connector, a new shroud may be put into place in the same manner.

In alternative embodiments of the invention, a shroud plug might be used to fit into any unused sockets. Such a plug includes the structure and features of the shroud 54 described herein but is in the form of a plug rather that being coupled with a connector. The plug locks and unlocks like the connector shroud as described.

While the present invention has been illustrated by the description of one or more embodiments thereof, and while the embodiments have been described in considerable detail, they are not intended to restrict or in any way limit the scope of the appended claims to such detail. Various features of the motor mounting assembly 10 shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope or spirit of the general inventive concept.

What is claimed is:

1. An electrical connector system comprising:

a connector including a plug;

a shroud extending over at least a portion of the plug and coupled with the plug;

a conductive socket configured for receiving the plug of the connector, the socket including a groove formed on an outer surface thereof;

the shroud including at least one spring finger having a lock portion thereon configured for engaging the groove for securing the connector in the socket;

a collar slidably mounted on the conductive socket, the collar configured for sliding between a locked position proximate to the socket groove and an unlocked position;

the collar further configured for engaging the at least one spring finger of the connector shroud in the locked position to hold the finger lock portion engaged with the groove to lock the connector in the socket.

2. The electrical connector system of claim 1 wherein the at least one spring finger flexes radially away from the socket when the connector plug is inserted into the socket, the finger flexing radially inwardly to drive the lock portion into the groove, when the plug is inserted into the socket, the collar holding the finger lock portion in the groove to lock the connector in the socket.

3. The electrical connector system of claim 2 further comprising a plurality of spring fingers with lock portions, the fingers flexing to drive the lock portions into the groove.

4. The electrical connector system of claim 3 wherein the lock portions of the spring fingers collectively form a flange structure around the connector to lock the connector with the socket.

5. The electrical connector system of claim 1 further comprising a mechanism for acting on the collar for moving the collar between the locked and unlocked positions.

6. The electrical connector system of claim 5 wherein the mechanism includes an interactive pinion gear and a rack gear, the collar configured to rotate with respect to the socket for moving between the locked and unlocked positions, at least one of the rack gear and pinion gear being coupled with the collar for imparting rotation of the collar upon interaction of the rack gear and pinion gear.

7. The electrical connector system of claim 6 wherein the pinion gear is incorporated with the collar and translation of the rack gear imparts the rotation of the collar through the pinion gear to move the collar between the locked and unlocked positions.

8. The electrical connector system of claim 5 wherein the mechanism includes a cam surface positioned proximate the collar, the collar including a complementary cam surface thereon, the mechanism operable for rotating the collar and directing the collar complementary cam surface against the mechanism cam surface to move the collar between the locked and unlocked positions.

9. The electrical connector system of claim 7 wherein the mechanism includes a cam surface positioned proximate the collar, the collar including a complementary cam surface thereon, the rotation of the collar through the pinion gear operable for directing the collar complementary cam surface against the mechanism cam surface to move the collar between the locked and unlocked positions.

10. The electrical connector system of claim 1 further comprising a biasing element configured for acting against the collar for biasing the collar to slide on the socket into the locked position.

11. The electrical connector system of claim 7 further comprising a biasing element configured for acting against the rack gear for biasing the rack gear to translate in a direction and rotate the collar.

12. An electrical connector system comprising:

a module including a plurality of conductive sockets configured for receiving a respective connector;

a connector including a plug for plugging into at least one of the sockets and including a lock portion;

at least one of the sockets of the module including a groove formed on an outer surface thereof, the groove configured to receive the lock portion of the connector;

a collar slidably mounted on the conductive socket, the collar configured for sliding between a locked position proximate to the socket groove and an unlocked position;

the collar further configured for engaging the connector lock portion in the locked position to lock the connector in the socket.

13. The electrical connector system of claim 12 further comprising a shroud extending over at least a portion of the plug and coupled with the plug, the shroud including at least one spring finger having the lock portion thereon configured for engaging the groove for securing the connector in the socket.

14. The electrical connector system of claim 13 wherein the at least one spring finger flexes radially away from the socket when the connector plug is inserted into the socket, the finger flexing radially inwardly to drive the lock portion into the groove, when the plug is inserted into the socket, the collar holding the finger lock portion in the groove to lock the connector in the socket.

15. The electrical connector system of claim 13 further comprising a plurality of spring fingers with lock portions, the fingers flexing to drive the lock portions into the groove.

16. The electrical connector system of claim 12 further comprising an interactive pinion gear and a rack gear, the collar configured to rotate with respect to the socket for moving between the locked and unlocked positions, the pinion gear being coupled with the collar for imparting rotation of the collar upon interaction of the rack gear and pinion gear.

17. The electrical connector system of claim 16 wherein the module includes a cam surface positioned proximate the collar, the collar including a complementary cam surface thereon, the pinion gear operable for rotating the collar and directing the collar complementary cam surface against the module cam surface to move the collar between the locked and unlocked positions.

18. The electrical connector system of claim 12 further comprising a biasing element configured for acting against the collar for biasing the collar to slide on the socket into the locked position.

19. The electrical connector system of claim 16 further comprising a biasing element configured for acting against the rack gear for biasing the rack gear to translate in a direction and rotate the collar.

* * * * *